US010612499B2

(12) United States Patent
Sakurai et al.

(10) Patent No.: US 10,612,499 B2
(45) Date of Patent: Apr. 7, 2020

(54) AIR INTAKE APPARATUS

(71) Applicants: AISIN SEIKI KABUSHIKI KAISHA, Kariya-shi, Aichi-ken (JP); TOYOTA JIDOSHA KABUSHIKI KAISHA, Toyota-shi, Aichi-ken (JP)

(72) Inventors: Yu Sakurai, Obu (JP); Naoki Tajima, Chiryu (JP); Tomohisa Senda, Kariya (JP); Hideaki Teramoto, Kariya (JP); Masaki Makihara, Okazaki (JP)

(73) Assignees: AISIN SEIKI KABUSHIKI KAISHA, Kariya-Shi, Aichi-Ken (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 0 days.

(21) Appl. No.: 15/779,234

(22) PCT Filed: Nov. 1, 2016

(86) PCT No.: PCT/JP2016/082373

§ 371 (c)(1),
(2) Date: May 25, 2018

(87) PCT Pub. No.: WO2017/094425

PCT Pub. Date: Jun. 8, 2017

(65) Prior Publication Data

US 2018/0372039 A1 Dec. 27, 2018

(30) Foreign Application Priority Data

Nov. 30, 2015 (JP) ..... 2015-233560

(51) Int. Cl.
*F02M 35/104* (2006.01)
*F02M 35/10* (2006.01)
(Continued)

(52) U.S. Cl.
CPC .... *F02M 35/10222* (2013.01); *F02M 35/104* (2013.01); *F02M 35/1036* (2013.01);
(Continued)

(58) Field of Classification Search
CPC ..... F02M 35/10222; F02M 35/104; F02M 35/1036; F02M 35/10209; F02M 35/10078; F02M 35/10354; F02M 35/10072; F02M 35/10039; F02M 35/10052; F02M 35/10111
See application file for complete search history.

(56) References Cited

U.S. PATENT DOCUMENTS

2004/0159299 A1 8/2004 Uchiyama
2005/0098846 A1 5/2005 Nagaoka
(Continued)

FOREIGN PATENT DOCUMENTS

EP 1 801 369 A1 6/2007
JP 3786098 B2 6/2006
(Continued)

OTHER PUBLICATIONS

International Search Report (PCT/ISA/210) dated Jan. 10, 2017, by the Japan Patent Office as the International Searching Authority for International Application No. PCT/JP2016/082373.
(Continued)

*Primary Examiner* — Jacob M Amick
(74) *Attorney, Agent, or Firm* — Buchanan Ingersoll & Rooney PC

(57) ABSTRACT

This air intake apparatus includes an air intake apparatus main body including a plurality of pieces bonded to each other along a split plane and an external gas passage formed inside the air intake apparatus main body by bonding the plurality of pieces to each other and including an external gas receiving port that directly receives external gas from a cylinder head and an external gas introduction port that introduces the external gas into a surge tank.

7 Claims, 4 Drawing Sheets

(51) Int. Cl.

| | |
|---|---|
| *F02M 35/112* | (2006.01) |
| *F02M 26/19* | (2016.01) |
| *F02M 26/20* | (2016.01) |
| *F02M 25/06* | (2016.01) |

(52) U.S. Cl.
CPC ..... *F02M 35/10039* (2013.01); *F02M 35/10052* (2013.01); *F02M 35/10072* (2013.01); *F02M 35/10078* (2013.01); *F02M 35/10111* (2013.01); *F02M 35/10354* (2013.01); *F02M 25/06* (2013.01); *F02M 26/19* (2016.02); *F02M 26/20* (2016.02); *F02M 35/112* (2013.01)

(56) References Cited

U.S. PATENT DOCUMENTS

| | | | | |
|---|---|---|---|---|
| 2006/0005820 | A1* | 1/2006 | Jeon ..... | F02M 35/10039 123/572 |
| 2006/0191505 | A1 | 8/2006 | Doko et al. | |
| 2006/0194392 | A1 | 8/2006 | Nagaoka | |
| 2011/0203559 | A1 | 8/2011 | Tanikawa et al. | |
| 2014/0014056 | A1 | 1/2014 | Sato | |

FOREIGN PATENT DOCUMENTS

| | | | |
|---|---|---|---|
| JP | 3964690 | B2 | 8/2007 |
| JP | 2011-169258 | A | 9/2011 |
| JP | 2011-220299 | A | 11/2011 |
| JP | 2014-181624 | A | 9/2014 |

OTHER PUBLICATIONS

Written Opinion (PCT/ISA/237) dated Jan. 10, 2017, by the Japan Patent Office as the International Searching Authority for International Application No. PCT/JP2016/082373.

Office Action (Notice of Reasons for Refusal) dated Jul. 2, 2019, by the Japanese Patent Office in corresponding Japanese Patent Application No. 2015-233560 and an English machine Translation of the Office Action. (9 pages).

* cited by examiner

AIR INTAKE APPARATUS

TECHNICAL FIELD

The present invention relates to an air intake apparatus, and more particularly, it relates to an air intake apparatus including an air intake apparatus main body that includes a plurality of pieces bonded to each other along a split plane.

BACKGROUND ART

In general, an air intake apparatus including an air intake apparatus main body that includes a plurality of pieces bonded to each other along a split plane is known. Such an air intake apparatus is disclosed in Japanese Patent No. 3964690, for example.

Japanese Patent No. 3964690 discloses a manifold (air intake apparatus) for a four-cylinder engine in which blow-by gas (external gas) is introduced into air intake pipes (air intake port). In this manifold disclosed in Patent Document 1, a manifold main body (air intake apparatus main body) including four air intake pipes is configured by bonding a first member and a second member (a plurality of pieces) each having a half structure to each other by vibration welding. In addition to forming the manifold main body, a distribution passage that introduces the blow-by gas into the air intake pipes is formed. The distribution passage for introducing the blow-by gas projects outward from the outer wall surface of the manifold main body. A blow-by gas tube that extends from a cylinder head of the engine is connected to a connector (external gas receiving port) of the distribution passage.

PRIOR ART

Patent Document

Patent Document 1: Japanese Patent No. 3964690

SUMMARY OF THE INVENTION

Problems to be Solved by the Invention

In the manifold disclosed in Japanese Patent No. 3964690, however, the distribution passage for introducing the blow-by gas including the connector projects (protrudes) outward from the outer wall surface of the manifold main body, and hence there is a problem that the entire manifold (air intake apparatus) is increased in size. In addition, it is necessary to connect the cylinder head of the engine and the distribution passage for introducing the blow-by gas to each other via the connector using the blow-by gas tube as a separate component, and hence there is a problem that the number of components that constitute the manifold (air intake apparatus) is increased.

The present invention has been proposed in order to solve the aforementioned problems, and an object of the present invention is to provide an air intake apparatus capable of being downsized while significantly reducing or preventing an increase in the number of components.

Means for Solving the Problems

In order to attain the aforementioned object, an air intake apparatus according to an aspect of the present invention includes an air intake apparatus main body including a plurality of pieces bonded to each other along a predetermined split plane in a state where a surge tank and an air intake port provided between the surge tank and a cylinder head of an internal combustion engine are split by the split plane, and an external gas passage formed inside the air intake apparatus main body by bonding the plurality of pieces to each other and including an external gas receiving port that directly receives external gas from the cylinder head and an external gas introduction port that introduces the external gas into the surge tank.

As hereinabove described, the air intake apparatus according to this aspect of the present invention includes the external gas passage formed inside the air intake apparatus main body by bonding the plurality of pieces to each other. Thus, the external gas passage does not project (does not protrude) outward from the outer wall surface of the air intake apparatus main body, and hence it is possible to significantly reduce or prevent an increase in the size of the air intake apparatus main body. Furthermore, the external gas passage includes the external gas receiving port that directly receives the external gas from the cylinder head such that a hose member (connection member) that connects the cylinder head of the internal combustion engine to the external gas passage is not necessary. Thus, the number of components that constitute the air intake apparatus can be reduced. Consequently, the air intake apparatus downsized while significantly reducing or preventing an increase in the number of components can be obtained.

Furthermore, in the aforementioned air intake apparatus according to the this aspect, the external gas passage is enclosed in (built into) the air intake apparatus main body, and hence the direct influence of outside air (running air in an engine room of a vehicle on which the internal combustion engine is mounted) on the external gas that flows through the external gas passage is significantly reduced or prevented. Therefore, even when the internal combustion engine is operated under the condition of a low outside air temperature (below the freezing point), cooling of the warm external gas from the internal combustion engine in the external gas passage is significantly reduced or prevented by heat received from the cylinder head and the heat retaining property of the external gas passage itself. That is, it is possible to significantly reduce or prevent condensation and freezing of moisture contained in exhaust recirculation gas recirculated to the internal combustion engine and blow-by gas (unburned air-fuel mixture) for ventilating a crankcase due to cooling in the external gas passage.

In the aforementioned air intake apparatus according to this aspect, the plurality of pieces preferably include openings that open in the predetermined split plane, respectively, and the external gas passage is preferably formed by bonding the plurality of pieces to each other such that the openings thereof communicate with each other.

According to this structure, when the plurality of pieces are bonded to each other, the openings of the respective pieces that open in the split plane are joined together such that the continuous external gas passage that extends from the external gas receiving port to the external gas introduction port can be formed inside the air intake apparatus main body. In other words, it is not necessary to incorporate a dedicated member for forming the external gas passage in the air intake apparatus main body, and hence it is possible to significantly reduce or prevent an increase in the number of components that constitute the air intake apparatus main body.

In the aforementioned air intake apparatus according to this aspect, the external gas passage preferably further includes a chamber provided between the external gas receiving port and the external gas introduction port and having a passage sectional area larger than those of the external gas receiving port and the external gas introduction port.

According to this structure, the flow velocity of the external gas taken in from the external gas receiving port can be reduced in the chamber and adjusted to a desired flow velocity. Therefore, the external gas can be introduced into the surge tank from the external gas introduction port at the optimum flow velocity, and hence intake air and the external gas can be mixed in the optimum state in the surge tank.

In the aforementioned air intake apparatus according to this aspect, the air intake port preferably includes a plurality of air intake pipes respectively connected to cylinders of the internal combustion engine, and the external gas introduction port is preferably disposed between the air intake pipes adjacent to each other.

According to this structure, the external gas passage including the external gas introduction port can be efficiently disposed in the air intake apparatus main body by effectively using an empty space between the air intake pipes adjacent to each other. Therefore, downsizing of the air intake apparatus main body can be easily achieved.

In this case, an end of the surge tank on one side in an array direction of the plurality of air intake pipes is preferably connected to a throttle valve, and the external gas introduction port is preferably disposed between the air intake pipes adjacent to each other on a side closer to the throttle valve.

According to this structure, the external gas can be rapidly mixed with the intake air by effectively using air flow immediately after the air flow passes through the throttle valve into the surge tank. Therefore, the intake air (mixed air of fresh air and the external gas) that has been sufficiently mixed with the external gas in the surge tank can be easily distributed to the plurality of air intake pipes.

In the aforementioned air intake apparatus according to this aspect, the air intake port preferably includes a plurality of air intake pipes respectively connected to cylinders of the internal combustion engine, and the external gas receiving port preferably faces the cylinder head and is preferably disposed between outlets of the air intake pipes adjacent to each other.

According to this structure, the cylinder head of the internal combustion engine and the external gas receiving port of the external gas passage can be easily connected to each other by simply connecting the air intake apparatus main body to the cylinder head. In addition, the external gas receiving port can be efficiently disposed in the air intake apparatus main body by effectively using the empty space between the air intake pipes adjacent to each other. Therefore, downsizing of the air intake apparatus main body 80 can be easily achieved.

In the aforementioned air intake apparatus according to this aspect, the external gas is preferably blow-by gas. According to this structure, it is possible to significantly reduce or prevent condensation and freezing of moisture contained in the blow-by gas due to cooling in the external gas passage.

In the aforementioned air intake apparatus according to this aspect, the air intake port preferably has an arcuate shape that is convex in a direction away from the internal combustion engine, and the external gas passage is preferably disposed on a concave side of the arcuate air intake port and between the air intake port and the surge tank. According to this structure, the external gas passage can be enclosed by effectively using the space between the air intake port and the internal combustion engine, and hence the air intake apparatus main body can be downsized. Furthermore, the air intake apparatus main body is downsized, and hence the mountability of the air intake apparatus main body in an engine room of an automobile can be improved.

In the aforementioned air intake apparatus in which the external gas passage further includes the chamber, in a state where the air intake apparatus main body is mounted on the cylinder head, the external gas introduction port is preferably disposed below the chamber and connected to an upper inner surface of the surge tank. According to this structure, the external gas can be introduced into the surge tank from the upper inner surface where air flow stagnates due to deviation from main flow of the intake air that flows into the surge tank, and hence the intake air and the external gas can be homogeneously mixed. Furthermore, the external gas introduction port is disposed below the chamber, and hence when the external gas flows through the external gas passage, it is possible to prevent accumulation of a large amount of moisture contained in the external gas in the external gas passage (chamber).

In the aforementioned air intake apparatus in which the external gas instruction port is disposed between the air intake pipes adjacent to each other on the side closer to the throttle valve, the external gas receiving port preferably faces the cylinder head and is preferably disposed between outlets of the air intake pipes adjacent to each other on a side closer to the throttle valve. According to this structure, not only the external gas introduction port but also the external gas receiving port is disposed between the outlets of the air intake pipes adjacent to each other on the side closer to the throttle valve, and hence the path length of the external gas passage can be minimized.

MODES FOR CARRYING OUT THE INVENTION

Embodiments of the present invention are hereinafter described on the basis of the drawings.

First Embodiment

The structure of an air intake apparatus 100 according to a first embodiment of the present invention is now described with reference to FIGS. 1 to 6.

Figure 1:
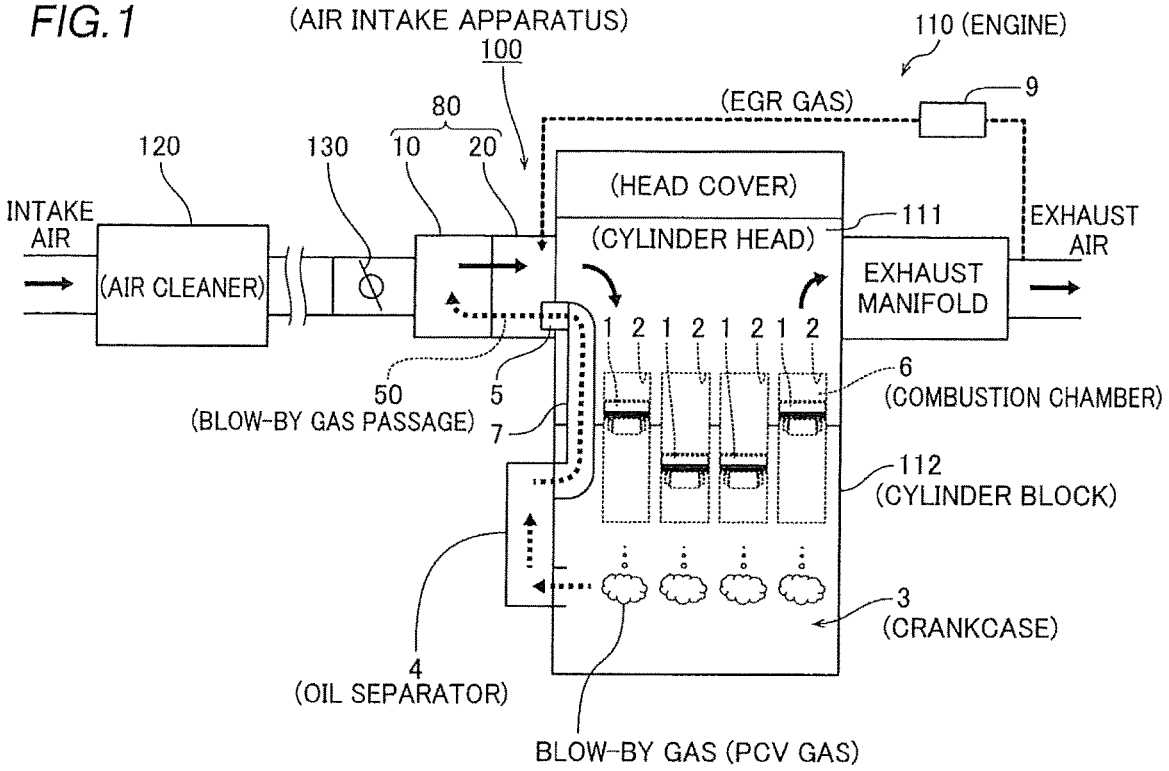
FIG. 1 A diagram schematically showing the arrangement of an engine and an air intake apparatus according to a first embodiment of the present invention.

The air intake apparatus 100 according to the first embodiment of the present invention is mounted on an in-line four-cylinder engine 110, as shown in FIG. 1. The air intake apparatus 100 partially constitutes an air intake system that supplies air to the engine 110, and the air intake apparatus 100 includes an air intake apparatus main body 80 including a surge tank 10 and an air intake port 20 disposed downstream of the surge tank 10. In the air intake apparatus 100, intake air (incoming air) that reaches an air intake 12 (see FIG. 2) via an air cleaner 120 and a throttle valve 130 flows into the surge tank 10. Then, the intake air is introduced from the surge tank 10 into a cylinder head 111 of the engine 110 via the air intake port 20.

Figure 2:
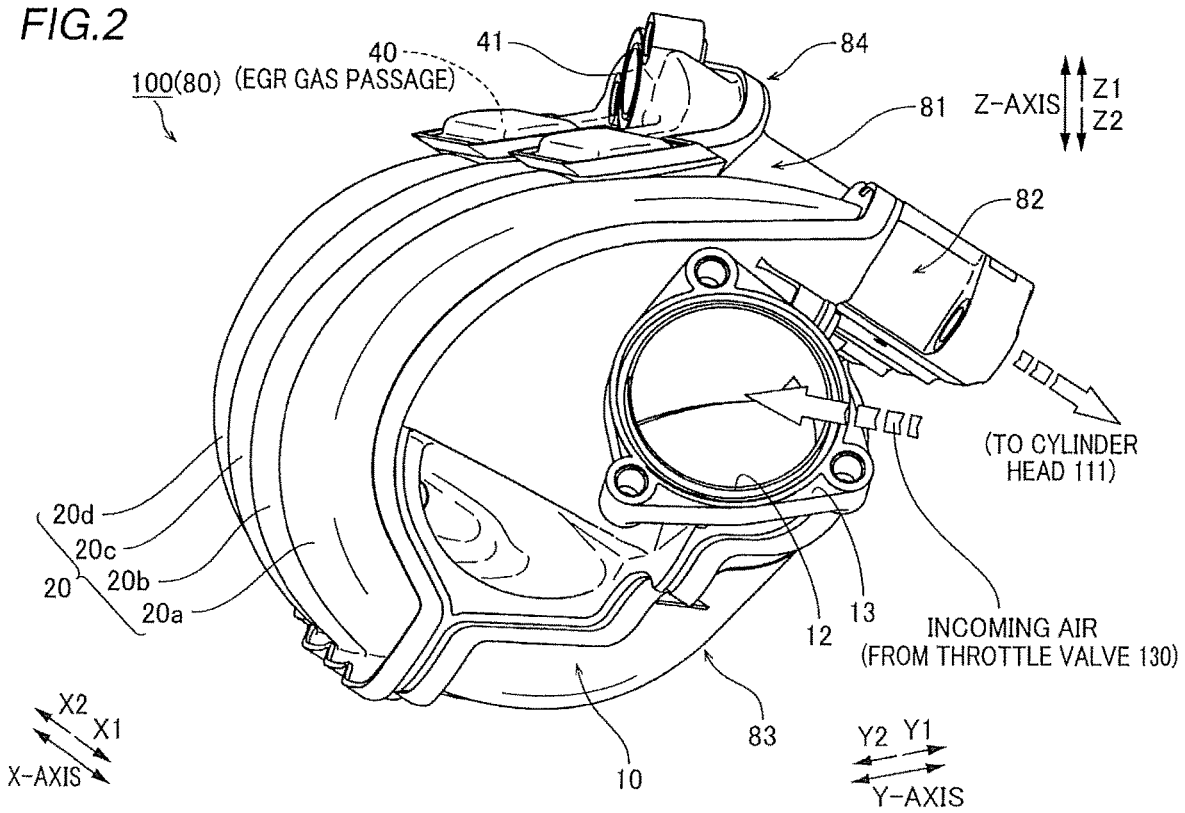
FIG. 2 A perspective view of the air intake apparatus according to the first embodiment of the present invention.
Figure 3:
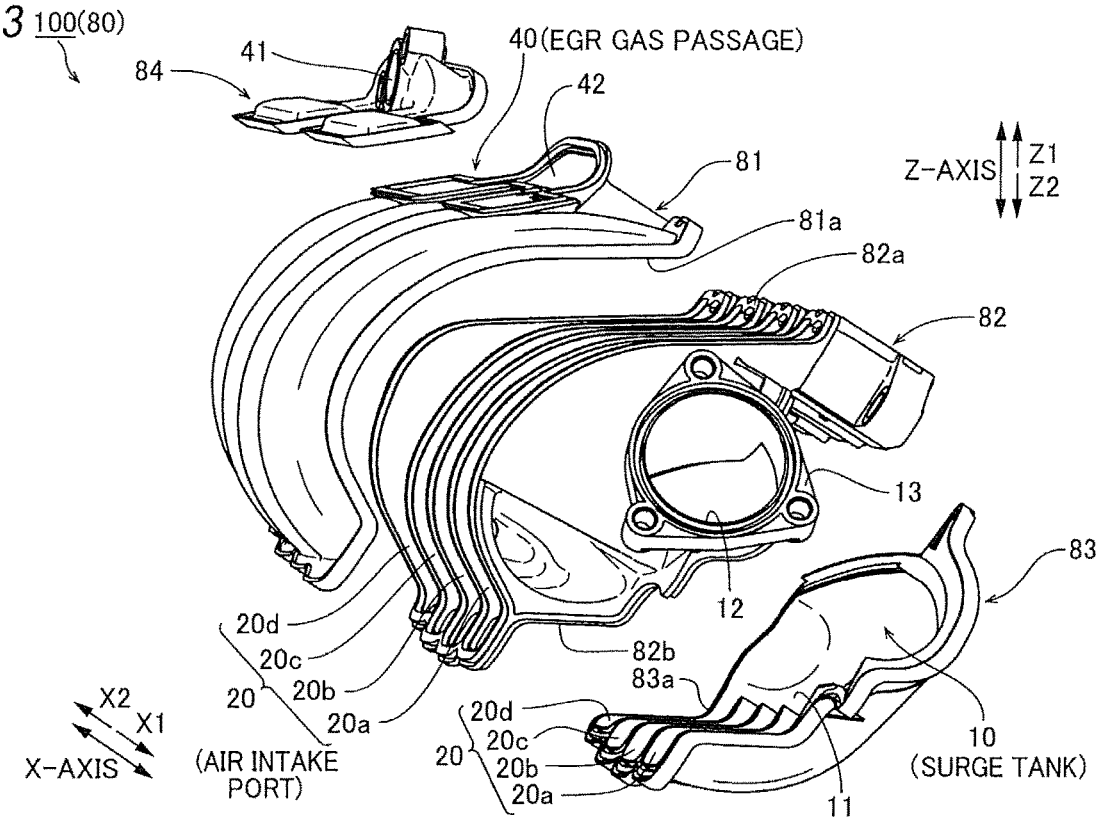
FIG. 3 An exploded perspective view of the air intake apparatus according to the first embodiment of the present invention.

As shown in FIG. 2, the air intake apparatus main body 80 is made of resin (polyamide resin, for example). Specifically, as shown in FIG. 3, an upper piece 81, a middle piece 82, a lower piece 83, and an EGR gas piece 84 are integrally bonded to each other by vibration welding. Thus, the surge tank 10 and the air intake port 20 are configured. As shown in FIGS. 2 and 3, the air intake port 20 is curved with an arcuate shape that is convex in an arrow Y2 direction away from the engine 110 (see FIG. 4).

The upper piece 81 constitutes the outer peripheral side of the curved air intake port 20 and the inner peripheral side of an EGR gas passage 40 described later. The middle piece 82 constitutes the inner peripheral side of the curved air intake port 20 and the upper half of the surge tank 10. The lower piece 83 constitutes the lower half of the surge tank 10 and a distribution passage portion to the air intake port 20. Therefore, in a state where the surge tank 10 and the air intake port 20 provided between the surge tank 10 and the cylinder head 111 (see FIG. 4) are split in advance by a predetermined split plane (a mating surface A described later), the air intake apparatus main body 80 is formed by bonding the surge tank 10 and the air intake port 20 to each other along this mating surface A.

The surge tank 10 includes a hollow body 11 that extends along a cylinder row (X-axis direction) of the engine 110 (see FIG. 1). Upstream ends of air intake pipes 20*a*, 20*b*, 20*c*, and 20*d* respectively connected to cylinders of the cylinder head 111 (see FIG. 1) are connected to a bottom portion of the body 11. The air intake port 20 includes the air intake pipes 20*a* to 20*d*. The air intake pipes 20*a* to 20*d* include outlets 21*a* to 21*d*. In the air intake apparatus main body 80, an end 13 of the air intake 12 on one side (X1 side) in the array direction (X-axis direction) of the air intake pipes 20*a* to 20*d* in the surge tank 10 is connected to the throttle valve 130 (see FIG. 1).

According to the first embodiment, as shown in FIG. 1, the air intake apparatus 100 includes a blow-by gas passage 50 (an example of an external gas passage). That is, blow-by gas (PCV gas) as external gas is recirculated to the engine 110 through the air intake apparatus 100. The blow-by gas denotes an unburned air-fuel mixture containing hydrocarbons (combustion gas) and blown out from gaps between the inner wall surfaces of cylinders 2 and pistons 1 to a crankcase 3 below the cylinders 2 during driving of the engine 110. In the engine 110, after the blow-by gas is discharged from the crankcase 3 to the outside, the blow-by gas is introduced into the air intake apparatus 100 (surge tank 10) via a PCV valve 5 loaded in the cylinder head 111 in a state where particulate oil mist is separated by an oil separator 4.

(Structure of Blow-by Gas Passage)

Figure 4:
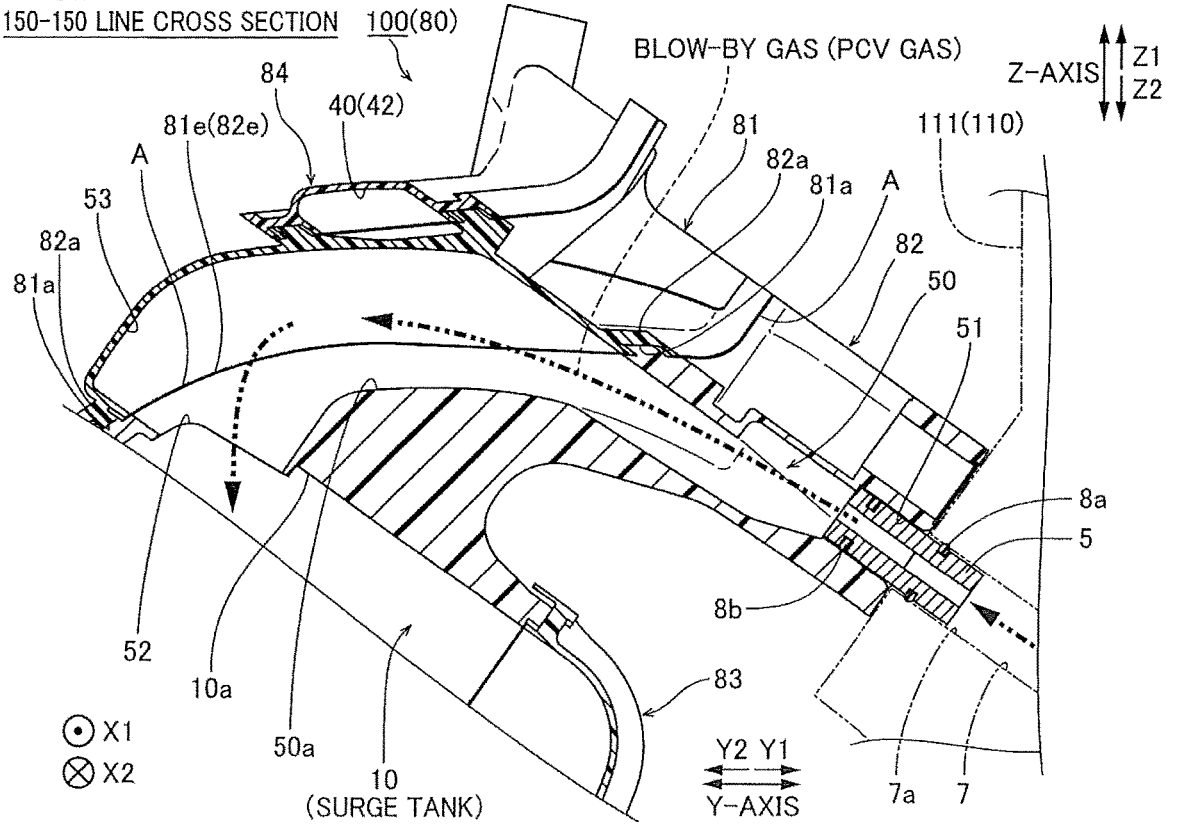
FIG. 4 An enlarged sectional view of a blow-by gas passage in the air intake apparatus according to the first embodiment of the present invention.

The blow-by gas passage 50 is not a hose member or the like as a separate component but formed integrally with the air intake apparatus main body 80. In addition, the blow-by gas passage 50 is configured as a passage (pipeline) that connects the crankcase 3 of the engine 110 to the surge tank 10. Specifically, as shown in FIG. 4, the blow-by gas passage 50 as well as the air intake pipes 20*a* to 20*d* is formed by vibration welding in a state where a rib-like and circumferential bonding portion 81*a* of the upper piece 81 and a rib-like and circumferential bonding portion 82*a* of the middle piece 82 face each other. Furthermore, the surge tank 10 is formed by vibration welding in a state where a rib-like and circumferential bonding portion 82*b* of the middle piece 82 and a rib-like and circumferential bonding portion 83*a* of the lower piece 83 face each other. FIG. 4 showing the sectional structure of the blow-by gas passage 50 corresponds to a cross section taken along the line 150-150 in FIGS. 5 and 6.

The inner wall surface 50*a* of the blow-by gas passage 50 is formed by the mating surface A (an example of a split plane) between the bonding portion 81*a* and the bonding portion 82*a*. That is, the upper piece 81 alone includes an opening 81*e* (see FIG. 4) that opens in the mating surface A, and the middle piece 82 alone includes an opening 82*e* (see FIG. 5) that opens in the mating surface A. The opening 81*e* and the opening 82*e* have the same sectional shape. The upper piece 81 and the middle piece 82 are circumferentially bonded to each other such that the openings 81*e* and 82*e* communicate with each other. Thus, one blow-by gas passage 50 is formed solely in the air intake apparatus main body 80 separately from the four air intake pipes 20*a* to 20*d*.

As shown in FIG. 4, the blow-by gas passage 50 includes a receiving port 51 (an example of an external gas receiving port) that directly receives the blow-by gas from the cylinder head 111 and an introduction port 52 (an example of an external gas introduction port) that introduces the blow-by gas into the surge tank 10. The introduction port 52 is connected to the upper inner surface 10*a* of the surge tank 10. The blow-by gas passage 50 is connected to the cylinder head 111 via the PCV valve 5. The PCV valve 5 is a check valve, and has a function of controlling the discharge amount of the blow-by gas. Furthermore, the PCV valve 5 is opened according to the pressure difference when the pressure on the blow-by gas passage 50 side is lower than the pressure on the crankcase 3 (see FIG. 1) side.

Specifically, one gas passage 7 that extends from the crankcase 3 (see FIG. 1) into a cylinder block 112 and the cylinder head 111 is formed inside the cylinder head 111. The PCV valve 5 is inserted into an exit 7*a* of the gas passage 7 via a seal member 8*a* to a predetermined extent. Furthermore, a seal member 8*b* is fitted into a portion of the PCV valve 5 exposed from the exit 7*a*. When the air intake apparatus main body 80 is assembled to the cylinder head 111, the PCV valve 5 is inserted into an end region of the receiving port 51 in the blow-by gas passage 50 via the seal member 8*b*. In this state, an outlet-side end of the air intake port 20 is fixed to the cylinder head 111 by fastening members (not shown). Thus, the blow-by gas passage 50 is directly connected to the cylinder head 111 via the PCV valve 5.

As shown in FIG. 4, the blow-by gas passage 50 includes a chamber 53 between the receiving port 51 and the introduction port 52. The mating surface A is located in the chamber 53. Furthermore, in a state where the air intake apparatus main body 80 is mounted on the cylinder head 111, the introduction port 52 is disposed below the chamber 53 and connected to the upper inner surface 10*a* of the surge tank 10. The passage sectional area of the chamber 53 is larger than those of the receiving port 51 and the introduction port 52. Therefore, the flow rate of the blow-by gas taken in from the receiving port 51 is reduced in the chamber 53 having a larger passage sectional area. In this case, the flow velocity is adjusted to a desired magnitude. The blow-by gas is introduced into the surge tank 10 from the introduction port 52 that opens on the upper inner surface 10*a* of the surge tank 10 in a state where the blow-by gas has reached an optimum flow velocity. Thus, the intake air and the blow-by gas are mixed in the optimum state in the surge tank 10.

Figure 5:
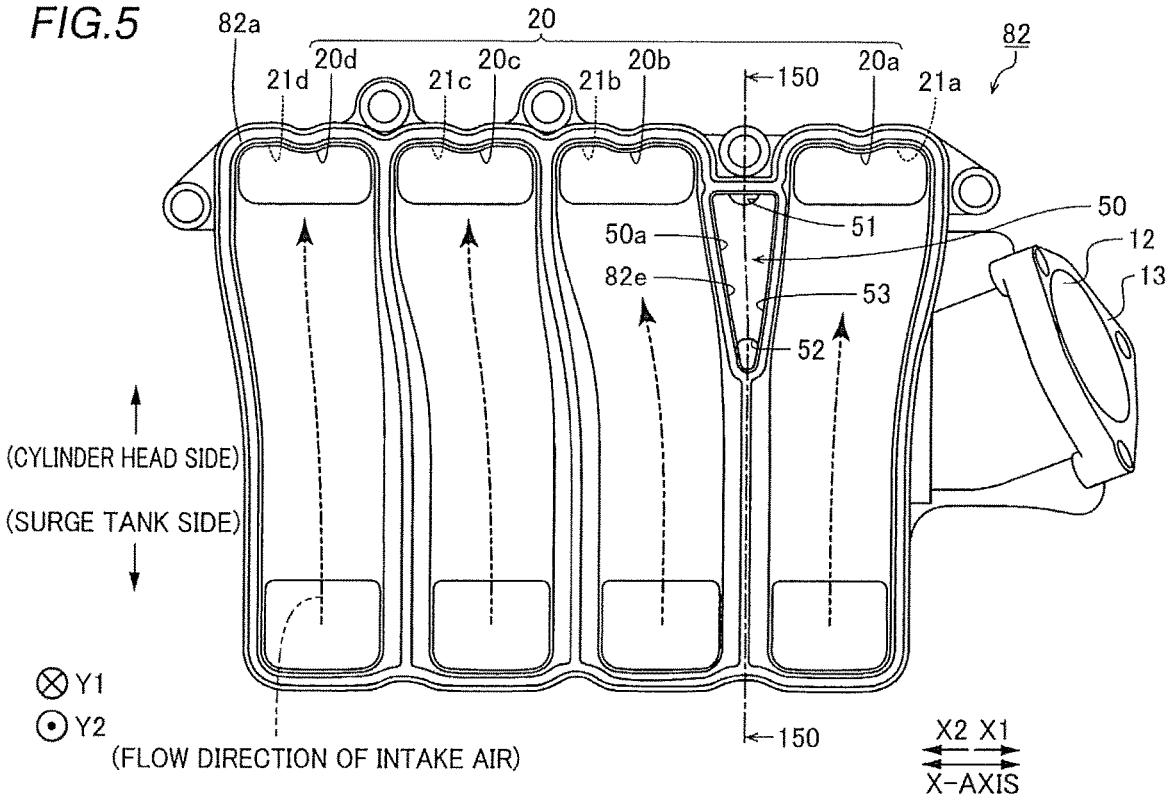
FIG. 5 A front view of a middle piece that constitutes the air intake apparatus according to the first embodiment of the present invention.
Figure 6:
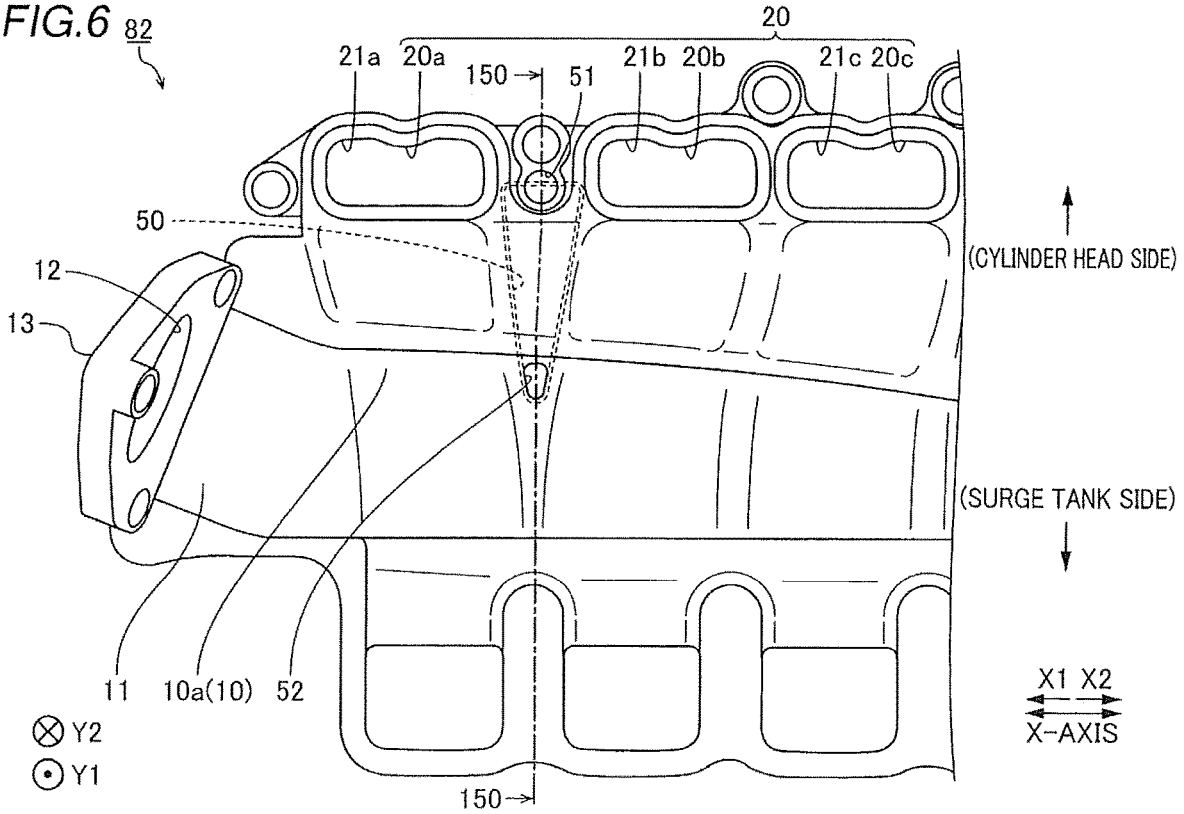
FIG. 6 A rear view of the middle piece that constitutes the air intake apparatus according to the first embodiment of the present invention.

As shown in FIGS. 5 and 6, both the receiving port 51 and the introduction port 52 are provided in the middle piece 82. The receiving port 51 from the gas passage 7 is disposed between the outlet 21*a* of the air intake pipe 20*a* and the outlet 21*b* of the air intake pipe 20*b* (see FIG. 6) adjacent to each other on the side (the X1 side closer to the air intake 12) closer to the throttle valve 130 (see FIG. 1). Furthermore, the receiving port 51 faces the cylinder head 111 (see FIG. 4) in a state where the receiving port 51 is disposed between the outlet 21*a* and the outlet 21*b*. The introduction port 52 to the surge tank 10 is also disposed between the air intake pipe 20*a* and the air intake pipe 20*b* adjacent to each other on the side closer to the throttle valve 130 (air intake 12).

The blow-by gas passage 50 is disposed on the concave side of the arcuate air intake port 20 (see FIG. 3) and between the air intake port 20 and the surge tank 10. Therefore, the blow-by gas passage 50 is enclosed in the air intake apparatus main body 80 by effectively using a space between a curved inner portion of the curved air intake port 20 and the cylinder block 112 (see FIG. 1).

As shown in FIG. 1, EGR gas, which is a portion of exhaust gas discharged from the cylinders 2 (combustion chambers 6) to the outside, is recirculated to the engine 110 through the air intake apparatus 100. The EGR gas separated from the exhaust gas is cooled to a predetermined temperature (about 100° C.) by an EGR cooler 9 and then introduced into the air intake apparatus main body 80. Specifically, as shown in FIGS. 2 and 3, the air intake apparatus main body 80 includes the EGR gas passage 40 that distributes the EGR gas to each of the air intake pipes 20*a* to 20*d*. The inner peripheral side of the EGR gas passage 40 is constituted by the upper piece 81, and the outer peripheral side thereof is constituted by the EGR gas piece 84. The EGR gas passage 40 includes an EGR gas inlet 41 and an EGR gas distributor 42 (see FIG. 3). The EGR gas distributor 42 is formed in a hierarchically branched tournament shape. An EGR gas inlet (not shown) is provided at the downstream end of the EGR gas distributor 42 divided in a tournament shape, and the EGR gas inlet communicates with each of the air intake pipes 20*a* to 20*d*.

Effects of First Embodiment

According to the first embodiment, the following effects can be obtained.

According to the first embodiment, as hereinabove described, the air intake apparatus 100 includes the blow-by gas passage 50 formed inside the air intake apparatus main body 80 by bonding the upper piece 81 and the middle piece 82 to each other. Thus, the blow-by gas passage 50 does not project (does not protrude) outward from the outer wall surface of the air intake apparatus main body 80, and hence it is possible to significantly reduce or prevent an increase in the size of the air intake apparatus main body 80. Furthermore, the blow-by gas passage 50 includes the receiving port 51 that directly receives the blow-by gas from the cylinder head 111 of the engine 110 such that a hose member (connection member) that connects the cylinder head 111 to the blow-by gas passage 50 is not necessary. Thus, the number of components that constitute the air intake apparatus 100 can be reduced. Consequently, the air intake apparatus 100 downsized while significantly reducing or preventing an increase in the number of components can be obtained.

In addition, the blow-by gas passage 50 is enclosed in (built into) the air intake apparatus main body 80, and hence the direct influence of outside air (running air in an engine room of a vehicle on which the engine 110 is mounted) on the blow-by gas that flows through the blow-by gas passage 50 is significantly reduced or prevented. Therefore, even when the engine 110 is operated under the condition of a low outside air temperature (below the freezing point), cooling of the warm blow-by gas from the crankcase 3 in the blow-by gas passage 50 is significantly reduced or prevented by heat received from the cylinder head 111 and the heat retaining property of the blow-by gas passage 50 itself. That is, it is possible to significantly reduce or prevent condensation and freezing of moisture contained in the blow-by gas for ventilating the crankcase 3 due to cooling in the blow-by gas passage 50.

According to the first embodiment, the opening 81*e* that opens in the mating surface A is provided in the upper piece 81, and the opening 82*e* that opens in the mating surface A is provided in the middle piece 82. Furthermore, the blow-by gas passage 50 is formed by bonding the upper piece 81 and the middle piece 82 to each other such that the openings 81*e* and 82*e* communicate with each other. Thus, when the upper piece 81 and the middle piece 82 are bonded to each other, the openings 81*e* and 82*e* that open in the mating surface A are joined together such that the continuous blow-by gas passage 50 that extends from the receiving port 51 to the introduction port 52 can be formed inside the air intake apparatus main body 80. In other words, it is not necessary to incorporate a dedicated member for forming the blow-by gas passage 50 in the air intake apparatus main body 80, and hence it is possible to significantly reduce or prevent an increase in the number of components that constitute the air intake apparatus main body 80.

According to the first embodiment, the blow-by gas passage 50 includes the chamber 53 provided between the receiving port 51 and the introduction port 52 and having a passage sectional area larger than those of the receiving port 51 and the introduction port 52. Thus, the flow velocity of the blow-by gas taken in from the receiving port 51 can be reduced in the chamber 53 and adjusted to a desired flow velocity. Therefore, the blow-by gas can be introduced into the surge tank 10 from the introduction port 52 at the optimum flow velocity, and hence the intake air and the blow-by gas can be mixed in the optimum state in the surge tank 10.

According to the first embodiment, the introduction port 52 is disposed between the air intake pipes 20*a* and 20*b*. Thus, the blow-by gas passage 50 including the introduction port 52 can be efficiently disposed in the air intake apparatus main body 80 by effectively using an empty space between the air intake pipes 20*a* and 20*b*. Therefore, downsizing of the air intake apparatus main body 80 can be easily achieved.

According to the first embodiment, the introduction port 52 is disposed between the air intake pipes 20*a* and 20*b* on the side closer to the throttle valve 130. Thus, the blow-by gas can be rapidly mixed with the intake air by effectively using air flow immediately after the air flow passes through the throttle valve 130 into the surge tank 10. Therefore, the intake air (mixed air of fresh air and the blow-by gas) that has been sufficiently mixed with the blow-by gas in the surge tank 10 can be easily distributed to a plurality of air intake pipes 20*a* to 20*d*.

According to the first embodiment, the receiving port 51 faces the cylinder head 111 and is disposed between the outlets 21*a* and 21*b* of the adjacent air intake pipes 20*a* and 20*b*. Thus, the cylinder head 111 and the receiving port 51 of the blow-by gas passage 50 can be easily connected to each other by simply connecting the air intake apparatus main body 80 to the cylinder head 111 of the engine 110. In addition, the receiving port 51 can be efficiently disposed in the air intake apparatus main body 80 by effectively using the empty space between the air intake pipes 20*a* and 20*b*. Therefore, downsizing of the air intake apparatus main body 80 can be easily achieved.

According to the first embodiment, the blow-by gas passage 50 is disposed on the concave side of the arcuate air intake port 20 and between the air intake port 20 and the surge tank 10. Thus, the blow-by gas passage 50 can be enclosed by effectively using the space between the air intake port 20 and the engine 110, and hence the air intake apparatus main body 80 can be downsized. Furthermore, the air intake apparatus main body 80 is downsized, and hence the mountability of the air intake apparatus main body 80 in an engine room of an automobile can be improved.

According to the first embodiment, in a state where the air intake apparatus main body 80 is mounted on the cylinder head 111, the introduction port 52 of the blow-by gas passage 50 is disposed below the chamber 53 and connected to the upper inner surface 10*a* of the surge tank 10. Thus, the blow-by gas can be introduced into the surge tank 10 from the upper inner surface 10*a* where air flow stagnates due to deviation from main flow of the intake air that flows into the surge tank 10, and hence the intake air and the blow-by gas can be homogeneously mixed. Furthermore, the introduction port 52 is disposed below the chamber 53, and hence when the blow-by gas flows through the blow-by gas passage 50, it is possible to prevent accumulation of a large amount of moisture (condensed water) contained in the blow-by gas in the blow-by gas passage 50.

According to the first embodiment, the receiving port 51 faces the cylinder head 111 and is disposed between the outlets 21*a* and 21*b* of the adjacent air intake pipes 20*a* and 20*b* on the side closer to the throttle valve 130. Thus, not only the introduction port 52 but also the receiving port 51 is disposed between the outlets 21*a* and 21*b* of the air intake pipes 20*a* and 20*b* adjacent to each other on the side closer to the throttle valve 130, and hence the path length of the blow-by gas passage 50 can be minimized.

Second Embodiment

Figure 7:
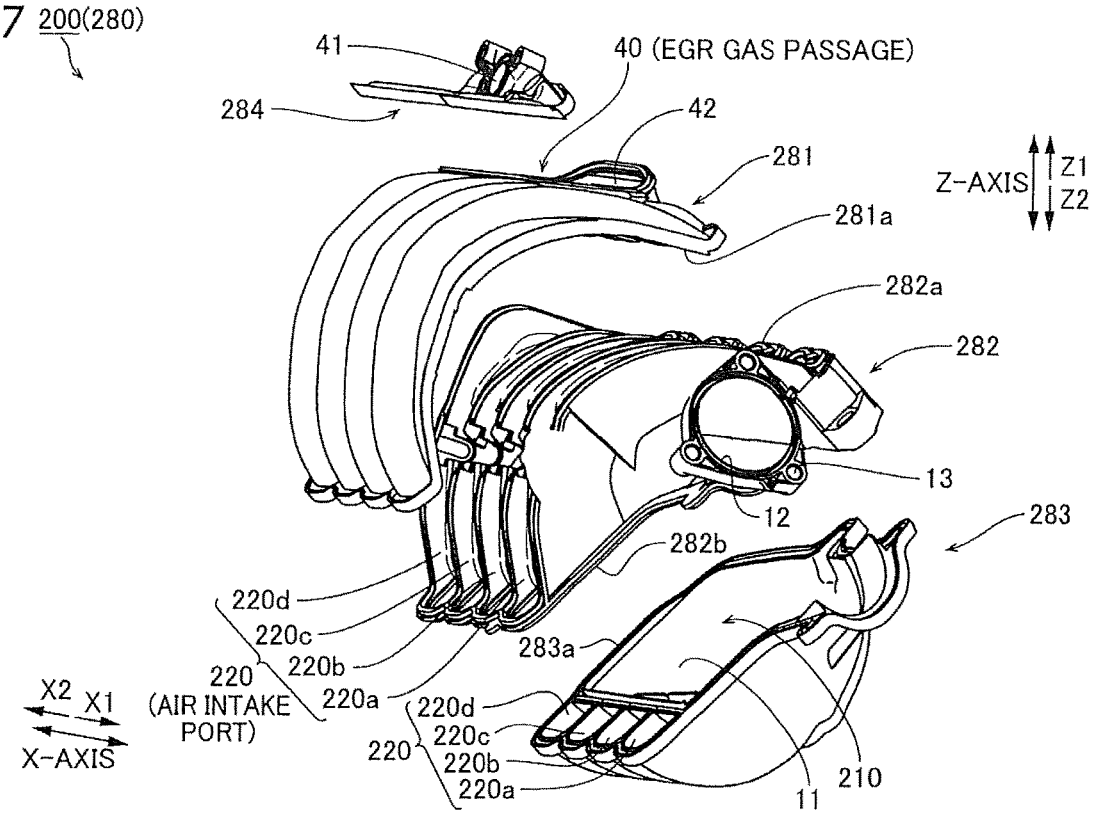
FIG. 7 An exploded perspective view of an air intake apparatus according to a second embodiment of the present invention.
Figure 8:
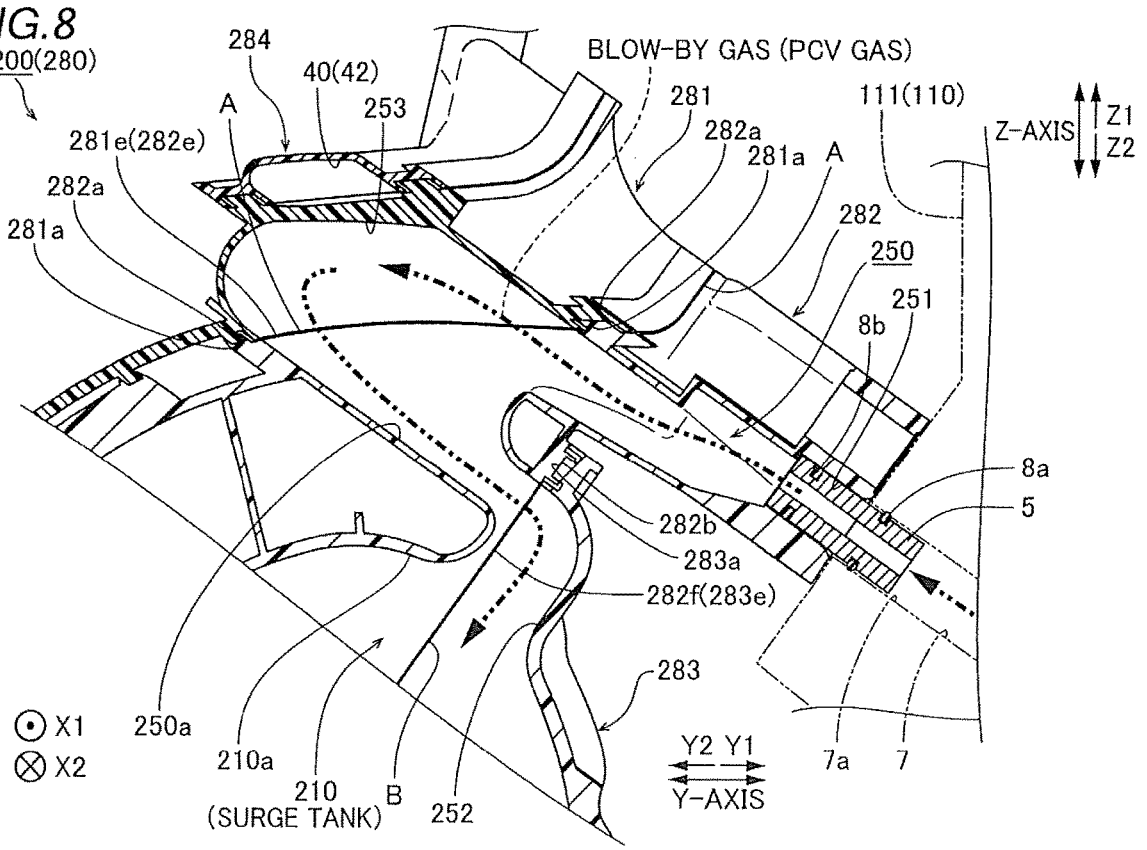
FIG. 8 An enlarged sectional view of a blow-by gas passage in the air intake apparatus according to the second embodiment of the present invention.

A second embodiment is now described with reference to FIGS. 7 and 8. In this second embodiment, an example in which a blow-by gas passage 250 (an example of an external gas passage) is constituted by three members of an upper piece 281, a middle piece 282, and a lower piece 283 is described.

An air intake apparatus 200 according to the second embodiment is mounted on an in-line four-cylinder engine 110. As shown in FIG. 7, in the air intake apparatus 200, an air intake apparatus main body 280 is formed by bonding the upper piece 281, the middle piece 282, the lower piece 283, and an EGR gas piece 284 to each other by vibration welding. As shown in FIG. 8, vibration welding is performed in a state where a bonding portion 281*a* of the upper piece 281 and a bonding portion 282*a* of the middle piece 282 face each other, and a bonding portion 282*b* of the middle piece 282 and a bonding portion 283*a* of the lower piece 283 face each other. Thus, the blow-by gas passages 250 as well as air intake pipes 220*a* to 220*d* is formed.

The inner wall surface 250*a* of the blow-by gas passage 250 is formed by a mating surface A between the bonding portion 281*a* and the bonding portion 282*a* and a mating surface B (an example of a split plane) between the bonding portion 282*b* and the bonding portion 283*a*. The upper piece 281 alone includes an opening 281*e* (see FIG. 8) that opens in the mating surface A, and the middle piece 282 alone includes an opening 282*e* that opens in the mating surface A and an opening 282*f* (see FIG. 8) that opens in the mating surface B. The lower piece 283 alone includes an opening 283*e* (see FIG. 8) that opens in the mating surface B. The opening 281*e* and the opening 282*e* have the same sectional shape, and the opening 282*f* and the opening 283*e* have the same sectional shape. The upper piece 281 and the middle piece 282 are circumferentially bonded to each other such that the openings 281*e* and 282*e* communicate with each other, and the middle piece 282 and the lower piece 283 are circumferentially bonded to each other such that the openings 282*f* and 283*e* communicate with each other. Thus, one blow-by gas passage 250 is formed solely in the air intake apparatus main body 280 separately from the air intake pipes 220*a* to 220*d*.

The blow-by gas passage 250 includes a receiving port 251 (an example of an external gas receiving port) that directly receives blow-by gas from a cylinder head 111 and an introduction port 252 (an example of an external gas introduction port) that introduces the blow-by gas into a surge tank 210. In addition, a chamber 253 is provided between the receiving port 251 and the introduction port 252. In a state where the air intake apparatus main body 280 is mounted on the cylinder head 111, the introduction port 252 is disposed below the chamber 253 and connected to the upper inner surface 210*a* of the surge tank 210. The passage sectional area of the chamber 253 is larger than those of the receiving port 251 and the introduction port 252. Therefore, the blow-by gas flows from the receiving port 251 to the chamber 253, is guided to the introduction port 252 while being turned back in the chamber 253, and is introduced into the surge tank 210.

The blow-by gas passage 250 bridges the exit side of an air intake port 220 and the surge tank 210 inward of the curve of the air intake port 220. Therefore, the air intake port 220 that extends in a bow shape upward from a bottom portion of the surge tank 210 is also connected by the blow-by gas passage 250, and the rigidity of the air intake apparatus main body 280 made of resin is enhanced. The remaining structures of the second embodiment are similar to those of the aforementioned first embodiment.

Effects of Second Embodiment

According to the second embodiment, as hereinabove described, the air intake apparatus 200 includes the blow-by gas passage 250 formed inside the air intake apparatus main body 280 by bonding the upper piece 281, the middle piece 282, and the lower piece 283 to each other. Thus, the blow-by gas passage 250 does not project outward from the air intake apparatus main body 280, and hence it is possible to significantly reduce or prevent an increase in the size of the air intake apparatus main body 280. Furthermore, the receiving port 251 that directly receives the blow-by gas from the cylinder head 111 of the engine 110 is provided in the blow-by gas passage 250 such that a hose member (connection member) that connects the cylinder head 111 to the blow-by gas passage 250 is not necessary, and hence the number of components that constitute the air intake apparatus 200 can be reduced. Consequently, the air intake apparatus 200 downsized while significantly reducing or preventing an increase in the number of components can be obtained.

According to the second embodiment, the opening 281*e* that opens in the mating surface A is provided in the upper piece 281, and the opening 282*e* that opens in the mating surface A is provided in the middle piece 282. Furthermore, the opening 282*f* that opens in the mating surface B is provided in the middle piece 282, and the opening 283*e* that opens in the mating surface B is provided in the lower piece 283. In addition, the blow-by gas passage 250 is formed by bonding the upper piece 281 and the middle piece 282 to each other such that the openings 281*e* and 282*e* communicate with each other and bonding the middle piece 282 and the lower piece 283 to each other such that the openings 282*f* and 283*e* communicate with each other. Thus, the openings 281*e* and 282*e* that open in the mating surface A are joined together, and the openings 282*f* and 283*e* that open in the mating surface B are joined together such that the continuous blow-by gas passage 250 that extends from the receiving port 251 to the introduction port 252 can be easily formed inside the air intake apparatus main body 280. The remaining effects of the second embodiment are similar to those of the aforementioned first embodiment.

Modified Examples

The embodiments disclosed this time must be considered as illustrative in all points and not restrictive. The range of the present invention is shown not by the above description of the embodiments but by the scope of claims for patent, and all modifications (modified examples) within the meaning and range equivalent to the scope of claims for patent are further included.

For example, while the blow-by gas passage 50 is formed by bonding the upper piece 81 and the middle piece 82 to each other in the aforementioned first embodiment, and the blow-by gas passage 250 is formed by bonding the upper piece 281, the middle piece 282, and the lower piece 283 to each other in the aforementioned second embodiment, the present invention is not restricted to this. The blow-by gas passage 50 may be formed inside the air intake apparatus main body by bonding four or more piece members to each other.

While the blow-by gas passage 50 (250) is provided between the air intake pipes 20*a* (220*a*) and 20*b* (220*b*) adjacent to each other in each of the aforementioned first and second embodiments, the present invention is not restricted to this. For example, the blow-by gas passage 50 (250) may be provided along the air intake pipe 20*a* closest to the throttle valve 130.

While the chamber 53 (253) having a larger passage sectional area is provided between the receiving port 51 (251) and the introduction port 52 (252) in each of the aforementioned first and second embodiments, the present invention is not restricted to this. The blow-by gas passage 50 may be formed without providing the chamber 53.

While the blow-by gas is introduced into the surge tank 10 (210) via the blow-by gas passage 50 (250) in each of the aforementioned first and second embodiments, the present invention is not restricted to this. For example, EGR gas (exhaust recirculation gas) may be introduced as the external gas according to the present invention into the surge tank 10 (210) via the external gas passage enclosed in the air intake apparatus main body 80 (280).

While the example in which no valve is provided in the air intake port 20 (220) to make the length of the air intake port 20 (220) (air intake path length) variable has been shown in each of the aforementioned first and second embodiments, the present invention is not restricted to this. For example, the present invention may be applied to an air intake apparatus including air intake pipes (air intake port) provided with a valve that switches the air intake path length.

While the present invention is applied to the air intake apparatus 100 (200) mounted on the in-line four-cylinder engine 110 in each of the aforementioned first and second embodiments, the present invention is not restricted to this. That is, the air intake apparatus according to the present invention may be applied to a multi-cylinder engine, a V-type multi-cylinder engine, or the like other than the in-line four-cylinder engine. Alternatively, the present invention may be applied to an air intake apparatus of an internal combustion engine (engine) mounted on equipment other than that for an automobile, for example. Furthermore, as the internal combustion engine, a gasoline engine, a diesel engine, a gas engine, or the like can be applied.

DESCRIPTION OF REFERENCE NUMERALS

10, 210: surge tank
10*a*, 210*a*: upper inner surface
20, 220: air intake port
20*a* to 20*d*, 220*a* to 220*d*: air intake pipe
21*a*, 21*b*: outlet
50, 250: blow-by gas passage (external gas passage)
51, 251: receiving port (external gas receiving port)
52, 252: introduction port (external gas introduction port)
53, 253: chamber
80, 280: air intake apparatus main body
81, 281: upper piece (piece)
81*e*, 82*e*, 281*e*, 282*e*, 282*f*, 283*e*: opening
82, 282: middle piece (piece)
83, 283: lower piece (piece)
100, 200: air intake apparatus
110: engine (internal combustion engine)
111: cylinder head
130: throttle valve

The invention claimed is:

1. An air intake apparatus comprising:

an air intake apparatus main body including a plurality of pieces bonded to each other along a predetermined split plane in a state where a surge tank and an air intake port provided between the surge tank and a cylinder head of an internal combustion engine are split by the split plane, and an external gas passage formed inside the air intake apparatus main body by bonding the plurality of pieces to each other and including an external gas receiving port that directly receives external gas from the cylinder head and an external gas introduction port that introduces the external gas into the surge tank, wherein the air intake port includes a plurality of air intake pipes respectively connected to cylinders of the internal combustion engine, and the external gas receiving port faces the cylinder head and is disposed between outlets of the air intake pipes adjacent to each other, the outlets being connected with the cylinder head.

2. The air intake apparatus according to claim 1, wherein the external gas passage further includes a chamber provided between the external gas receiving port and the external gas introduction port and having a passage sectional area larger than those of the external gas receiving port and the external gas introduction port.

3. The air intake apparatus according to claim 2, wherein in a state where the air intake apparatus main body is mounted on the cylinder head, the external gas introduction port is disposed below the chamber and connected to an upper inner surface of the surge tank.

4. The air intake apparatus according to claim 1, wherein an end of the surge tank on one side in an array direction of the plurality of air intake pipes is connected to a throttle valve, and the external gas introduction port is disposed between the air intake pipes adjacent to each other on a side closer to the throttle valve.

5. The air intake apparatus according to claim 4, wherein the external gas receiving port faces the cylinder head and is disposed between outlets of the air intake pipes adjacent to each other on a side closer to the throttle valve.

6. The air intake apparatus according to claim 1, wherein the external gas is blow-by gas.

7. The air intake apparatus according to claim 1, wherein the air intake port has an arcuate shape that is convex in a direction away from the internal combustion engine, and the external gas passage is disposed on a concave side of the arcuate air intake port and between the air intake port and the surge tank.

* * * * *